United States Patent [19]

Sato

[11] Patent Number: 4,881,834

[45] Date of Patent: Nov. 21, 1989

[54] PRINTING APPARATUS CAPABLE OF BACKLASH REGULATION

[75] Inventor: Yougi Sato, Nagoya, Japan

[73] Assignee: Brother Kogyo Kabushiki Kaisha, Aichi, Japan

[21] Appl. No.: 194,312

[22] Filed: May 16, 1988

[30] Foreign Application Priority Data

May 14, 1987 [JP] Japan ..... 62-117582

[51] Int. Cl.[4] ..... B41J 19/30; B41J 25/30

[52] U.S. Cl. ..... 400/279; 400/322; 400/577

[58] Field of Search ..... 400/322, 323, 320, 577, 400/903, 279

[56] References Cited

U.S. PATENT DOCUMENTS 4,044,882 8/1977 Weinke et al. ..... 400/322 X
4,311,398 1/1982 Gerjets ..... 400/144.2 X
4,403,301 9/1983 Fessel ..... 400/62 X

FOREIGN PATENT DOCUMENTS 62084 4/1983 Japan ..... 400/577

*Primary Examiner*—Paul T. Sewell
*Attorney, Agent, or Firm*—Barnes & Thornburg

[57] ABSTRACT

In a carriage driving system of a printing apparatus, due to play between gears and elongation of a wire or belt, a positional error is produced in the stop position of a carriage when the carriage is moved in the backspacing direction. Then, in the conventional printing apparatus, the carriage is backspaced while the error is regulated every time data is inputted in the centering mode or the right margin flash mode, but this increases the number of times of movement of the carriage, and therefore extra vibration and noise are generated. Disclosed is a printing apparatus comprising a regulating means for controlling a printing means to regulate a positional deviation in response to a print start command signal in a specified mode such as a centering mode and a right margin flash mode.

4 Claims, 7 Drawing Sheets

PRINTING APPARATUS CAPABLE OF BACKLASH REGULATION

BACKGROUND OF THE INVENTION

The present invention relates to a printing apparatus, and specifically relates to a printing apparatus wherein regulation of positional errors due to backlash and elongation of a wire or belt of carriage driving means is performed in response to a print start command signal in printing in a right margin flush printing mode, a centering printing mode or the like.

Generally, printing apparatuses such as electronic typewriters are constituted in a manner capable of setting to a typewriter mode, a memory mode (memory-display mode) or the like, and in the typewriter mode, the apparatuses can be set to a right margin flush mode (hereinafter referred to as RMF mode) wherein a desired character string or document can be printed while justified to the right margin position, and to a centering mode (hereinafter referred to as CTR mode) wherein, for example, a title of the document can be printed at the center of a print line.

When this RMF mode is set, a carriage is moved to the right margin position, and inputted data is stored in an input buffer, and the data of the input buffer are printed respectively in the entirety at a predetermined print position in response to a print start command signal from a return key or the like.

Also, when the CTR mode is set, the carriage is moved to the center of the print line, and inputted data is stored in the input buffer, and the data of the input buffer are printed respectively in the entirety at a predetermined print position in response to the print start command signal from the return key or the like.

Furthermore, another configuration is also proposed to provide a measure of character input in a manner that when the RMF mode or the CTR mode is set, the carriage is moved to a predetermined position, thereafter a character is inputted, and then the carriage is moved by one character at a time in the counter printing direction (backspacing direction) from the right margin position every time a character is inputted in the RMF mode, and the carriage is moved by a half of character at a time in the counter printing direction every time a character is inputted in the CTR mode.

For example, in a word processor adapted for filling in blanks on preprinted forms which is disclosed in the U.S. Pat. No. 4,403,301, upon actuation of a character key, the carriage is moved relative to the record carrier without printing out the character in a special mode, and the character data fed-in are stored in a memory, and then the characters stored in the memory are printed out only upon receipt of a separate instruction signal which may be, for example, a special printout function signal, a carriage tabulation jump signal or a line shift signal.

However, in moving the carriage to provide this measure of character input, a positional deviation is produced at the first print position due to the backlash between gears and the elongation of a wire or belt in the driving mechanism driving the carriage. To eliminate this positional deviation, configuration is devised in a manner that the carriage is moved by a predetermined extra distance every time of movement in the counter printing direction, and thereafter the carriage is moved by a predetermined distance in the printing direction (spacing direction), and thereby the backlash of the carriage is corrected.

In the above-mentioned electronic typewriters, to eliminate the positional deviation every time of character input in the RMF mode or the CTR mode, configuration is made so as to compensate (correct) the backlash of the carriage. However, despite that printing is not executed, every time data is inputted before a print start command, unnecessary control of backlash compensation is performed, and therefore there exists a problem that extra vibration and noise attending on the backlash compensation are generated.

SUMMARY OF THE INVENTION

The principal object of the present invention is to prevent a print deviation caused by backlash of gear or elongation of a belt or wire in a carriage driving mechanism.

To be further detailed, the object of the present invention is to provide a printing apparatus capable of reducing vibration and noise attending on regulation of positional deviation by regulating a positional deviation of the carriage driving means in response to a print start command signal in printing in the right margin flush-mode or the centering mode.

A printing apparatus according to the present invention comprises inputting means for inputting code data of characters and various command signals; printing means for printing characters on a print paper with a print head mounted on a carriage movable forward and backward along a print line; store means for storing inputted data from the inputting means; control means for controlling the printing means; mode setting means for setting the control means at a specified mode in which, according to a command signal from the inputting means, each inputted data is stored in the store means successively while backspacing the carriage, and then the inputted data in the store means are printed together in response to a print start command signal; regulating means for controlling the printing means to regulate a positional deviation in a carriage driving system in response to the print start command signal in the specified mode.

When regulating the positional deviation, for example, the printing means moves the carriage backward by an amount predetermined according to a print pitch and then moves the carriage forward by the same amount of print pitch only once before starting of printing.

By regulating the positional deviation in such a manner, the positional deviation of the carriage is eliminated, and thereby each of characters can be printed on the print position without an error.

Since unnecessary regulation of the positional deviation is not performed every time data is inputted before a print start command signal is inputted, vibration and noise attending on regulation of positional deviation of the carriage can be reduced.

BRIEF DESCRIPTION OF THE DRAWINGS

Drawings show a preferred embodiment in accordance with the present invention.

DETAILED DESCRIPTION OF THE PREFERRED EMBODIMENT

Hereinafter, description is made on an embodiment in accordance with the present invention based on drawings.

This embodiment is of the case where the present invention is applied to an electronic typewriter.

Figure 1:
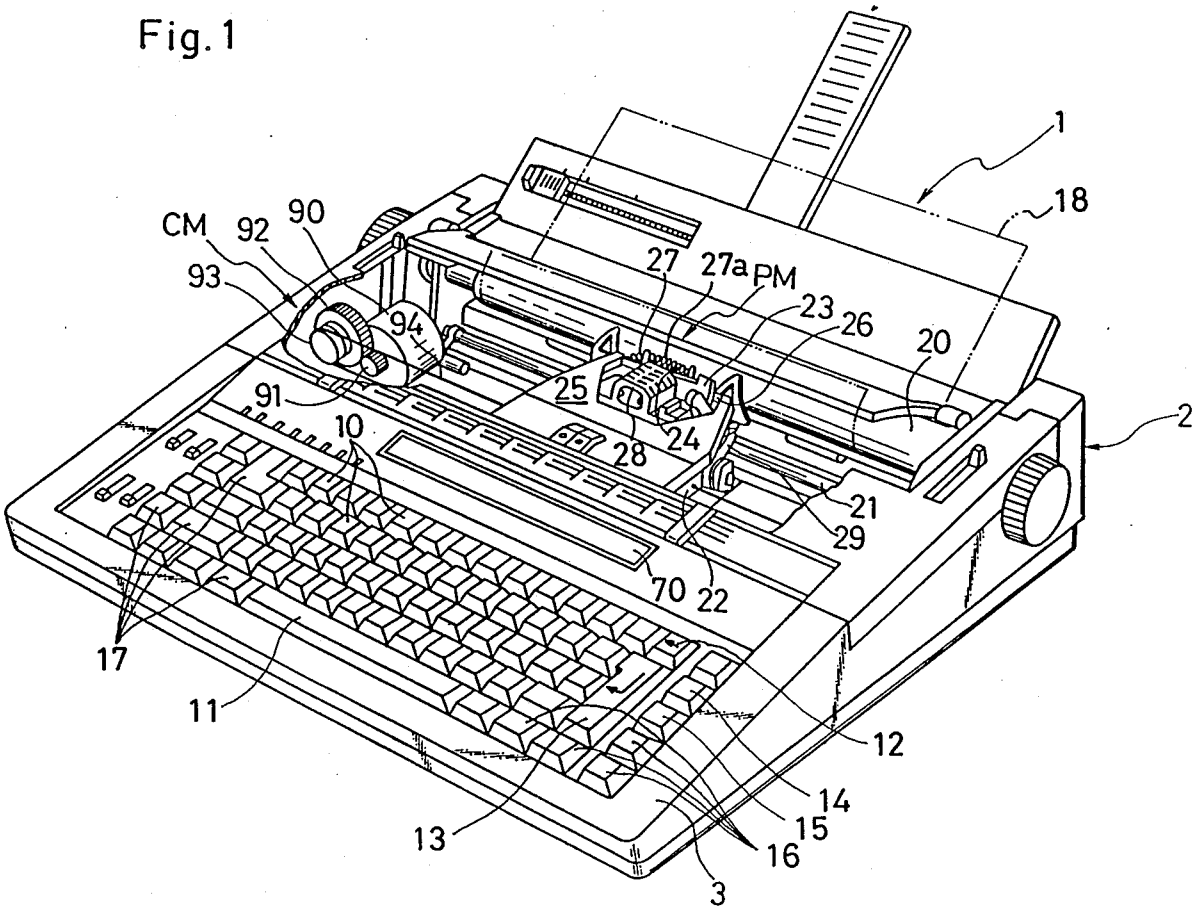
FIG. 1 is a perspective view of an electronic typewriter.

As shown in FIG. 1, a keyboard 3 is disposed in the front part of a main frame 2 of an electronic typewriter 1, and a printing mechanism PM is disposed behind the keyboard 3 in the main frame 2, and a one-line liquid crystal display 70 for displaying characters and symbols is installed in the rear part of the keyboard 3.

The keyboard 3 is provided with character keys 10 including alphabet keys, numeral keys and symbol keys, a space key 11, a backspace key 12, a return key 13, a right margin flush key (hereafter referred to as RMF key) 14 for setting a right margin flush mode (RMF mode) wherein inputted data string is printed while right end justified, a centering key (hereafter, referred to as CTR key) 15 for setting a centering mode (CTR mode) wherein inputted character string is printed at the center of print line and various function keys 16, 17 likewise normal typewriters.

Figure 2:
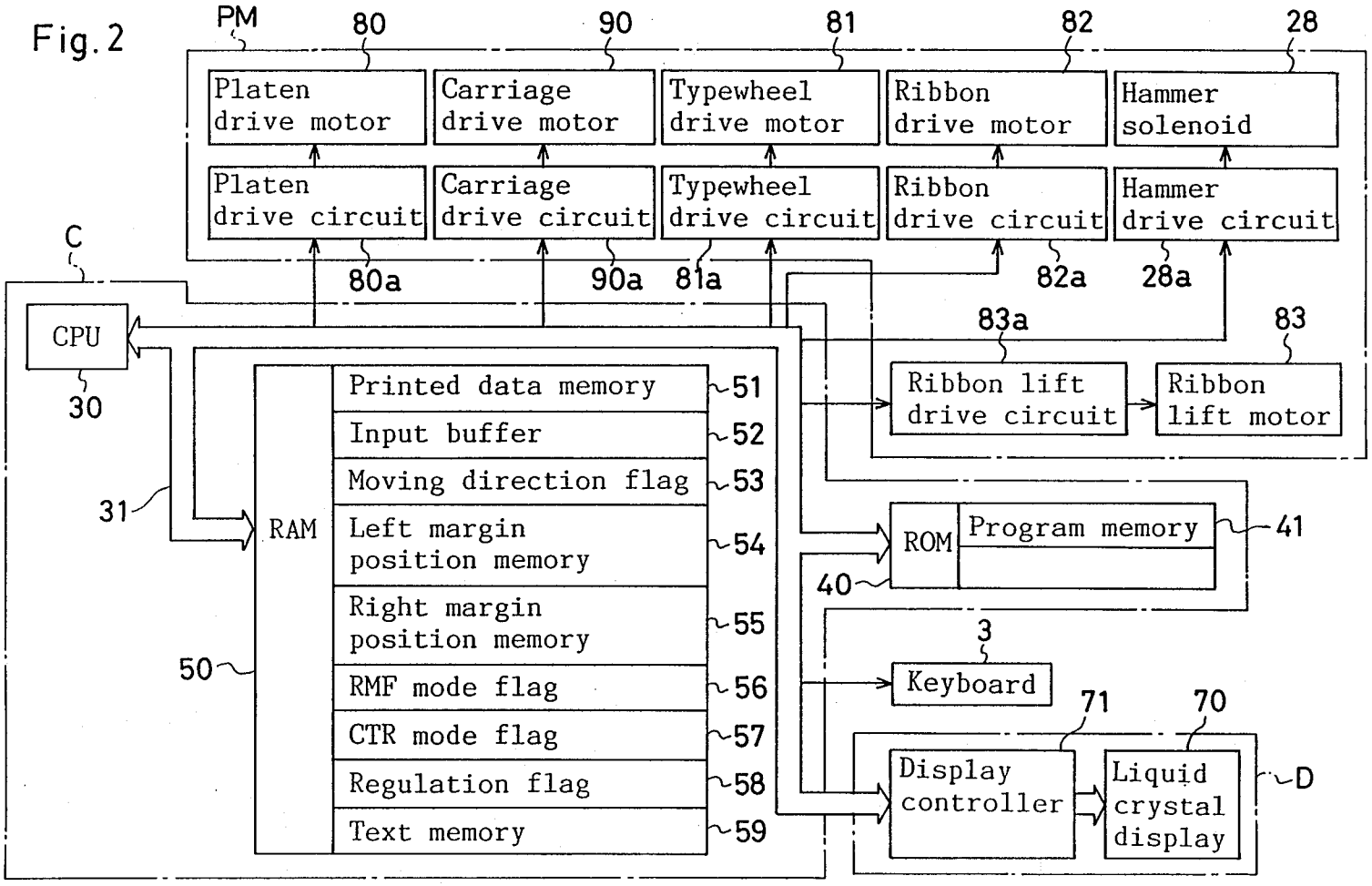
FIG. 2 is a block diagram of a controlling system of the electronic typewriter in FIG. 1, FIG. 3(*a*) through FIG. 3(*e*) are flow charts of a routine of controlling compensation of backlash.

As illustrated in FIG. 1 and FIG. 2, the printing mechanism PM is provided at least with a platen 20 feeding a print paper, a platen drive motor 80 and a platen drive circuit 80*a*, a carriage 22 supported by a guide 21 parallel with the platen 20, a carriage drive motor 90 for driving the carriage 22 right and left reciprocatively and a carriage drive circuit 90*a*, a typewheel 24 housed in a wheel cassette 23, a typewheel drive motor 81 and a typewheel drive circuit 81*a*, a print ribbon 26 stored in a ribbon cassette 25, a ribbon drive motor 82 for taking-up the ribbon 26 and a ribbon drive circuit 82*a*, a print hammer (not shown) for hammering a type element 27 of the typewheel 24, a hammer solenoid 28 for driving the print hammer and a hammer drive circuit 28*a*, a ribbon change-over mechanism selectively disposing the print ribbon 26 or a correction ribbon 29 at the print position, with a ribbon lift motor 83 and a ribbon lift drive circuit 83*a*.

A print head 27*a* of the carriage 22 consists of the print hammer, a type element 27 of the typewheel 24 located at the position facing it and the print ribbon 26 facing this type element 27.

The carriage 22 is moved reciprocatively along a print line on a print paper 18 by a carriage driving mechanism CM as shown in the U.S. Pat. No. 4,044,882. The carriage driving mechanism CM is constituted with a carriage drive motor 90 installed in the vicinity of one side wall of the main frame 2, a driving gear 91 mounted on the motor shaft thereof, a transmission gear 92 engaged with the driving gear 91, a driving pulley 93 formed integrally with the transmission gear 92, a driven pulley (not illustrated) installed in the vicinity of the other side wall of the main frame 2, and a wire 94 which is set around the both pulleys and both ends of which is fixed to the carriage 22.

The above-mentioned printing mechanism PM is similar to the printing mechanism of the average electronic typewriter.

Next, description is made on the whole configuration of a controlling system of the electronic typewriter with reference to a block diagram in FIG. 2.

The electronic typewriter 1 is configurated basically with the keyboard 3, the printing mechanism PM, a displaying mechanism D, a controlling apparatus C, and the keyboard 3, the printing mechanism PM and the displaying mechanism D are connected to a CPU (Central Processing Unit) 30 of the controlling apparatus C through a bus 31 including a data bus and an address bus.

The controlling apparatus C is constituted with the CPU 30, and a ROM (Read Only Memory) 40 and a RAM (Random Access Memory) 50 which are connected to the CPU 30 through the bus 31.

A program memory 41 of the ROM 40 stores a control program for controlling the printing mechanism PM and the displaying mechanism D in correspondence to code data inputted from each character key 10 and various function keys 16, 17 on the keyboard 3, a control program for controlling regulation of a positional deviation as described later. The above-mentioned regulation of the positional deviation means to compensate a deviation of the position of the carriage caused by a play between gears or elongation of the wire 94 comprised in the carriage driving mechanism CM.

The RAM 50 is provided with a printed data memory 51 for sequentially storing about 500 characters of code data of printed characters and symbols in correspondence to the print position, an input buffer 52 for storing data of characters and symbols which is inputted from the keyboard 3 or read from a text memory 59 and is displayed on the display 70, the text memory 59 for storing inputted data as file data, a moving direction flag 53 which is set when a key such as the space key 11 or the backspace key 12 is operated and the carriage 22 is moved in the printing direction (spacing direction) and is reset when it is moved in the counter printing direction (backspacing direction), a left margin position memory 54 for storing the set left margin position, a right margin position memory 55 for storing the set right margin position, a RMF mode flag 56 which is set when the RMF mode is set, a CTR mode flag 57 which is set when the CTR mode is set, a regulation flag 58 which is set when the RMF mode or the CTR mode is set and directs regulation of positional deviation immediately before starting printing, and the like.

Based on the control program, the CPU 30 makes the printing mechanism PM print characters and symbols corresponding to data inputted from each character key 10, and makes the printed data memory 51 sequentially store the printed data in correspondence to the print position. In the memory mode, the CPU 30 makes the input buffer 52 store inputted data of one print line, makes the display 70 display it, and makes the text memory 59 store that data of one print line in response to an operation of the return key 13.

The displaying mechanism D has a general configuration comprising the display 70 consisting of a liquid crystal display and a display controller 71 for outputting drive signals to the display 70.

Figure 3:
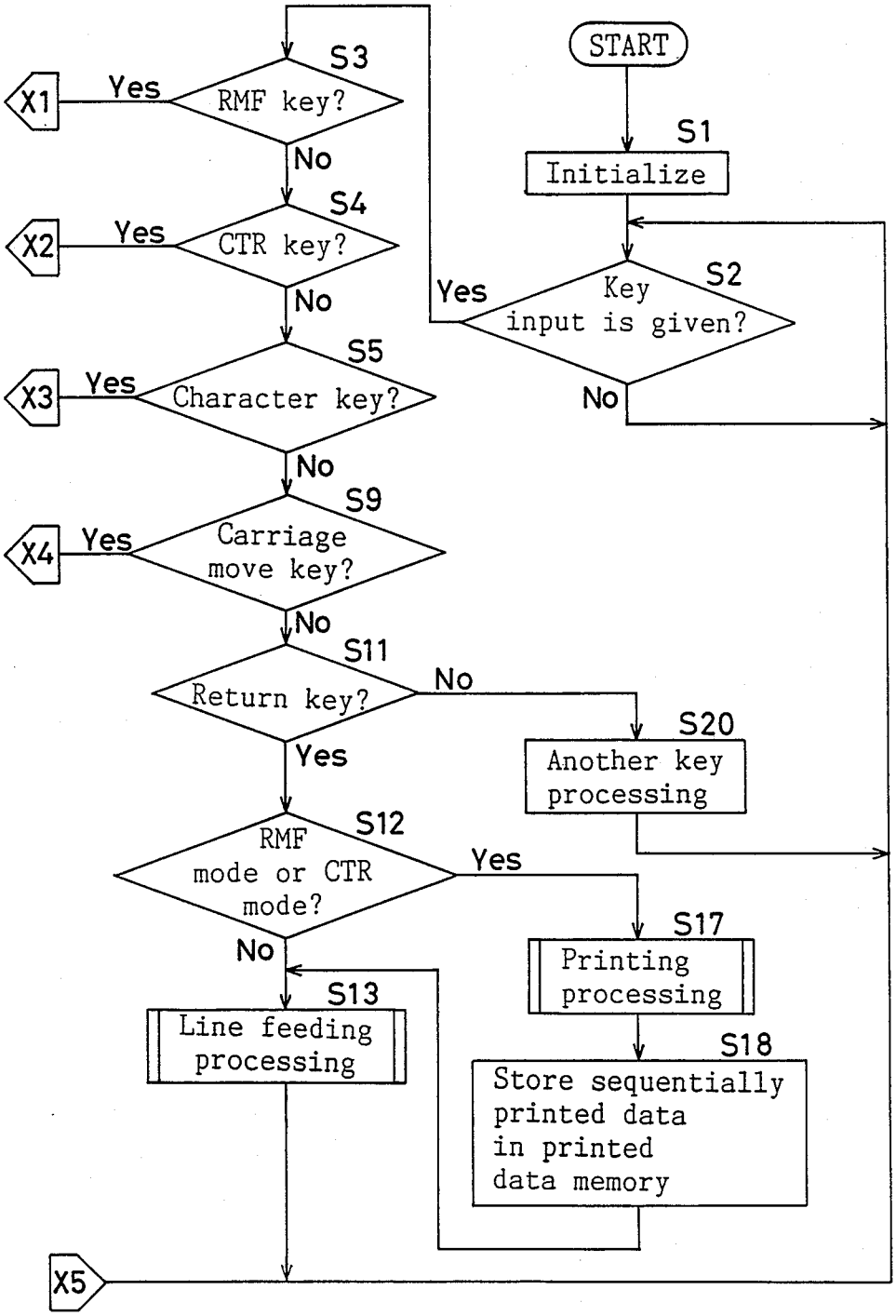
Figure 3:
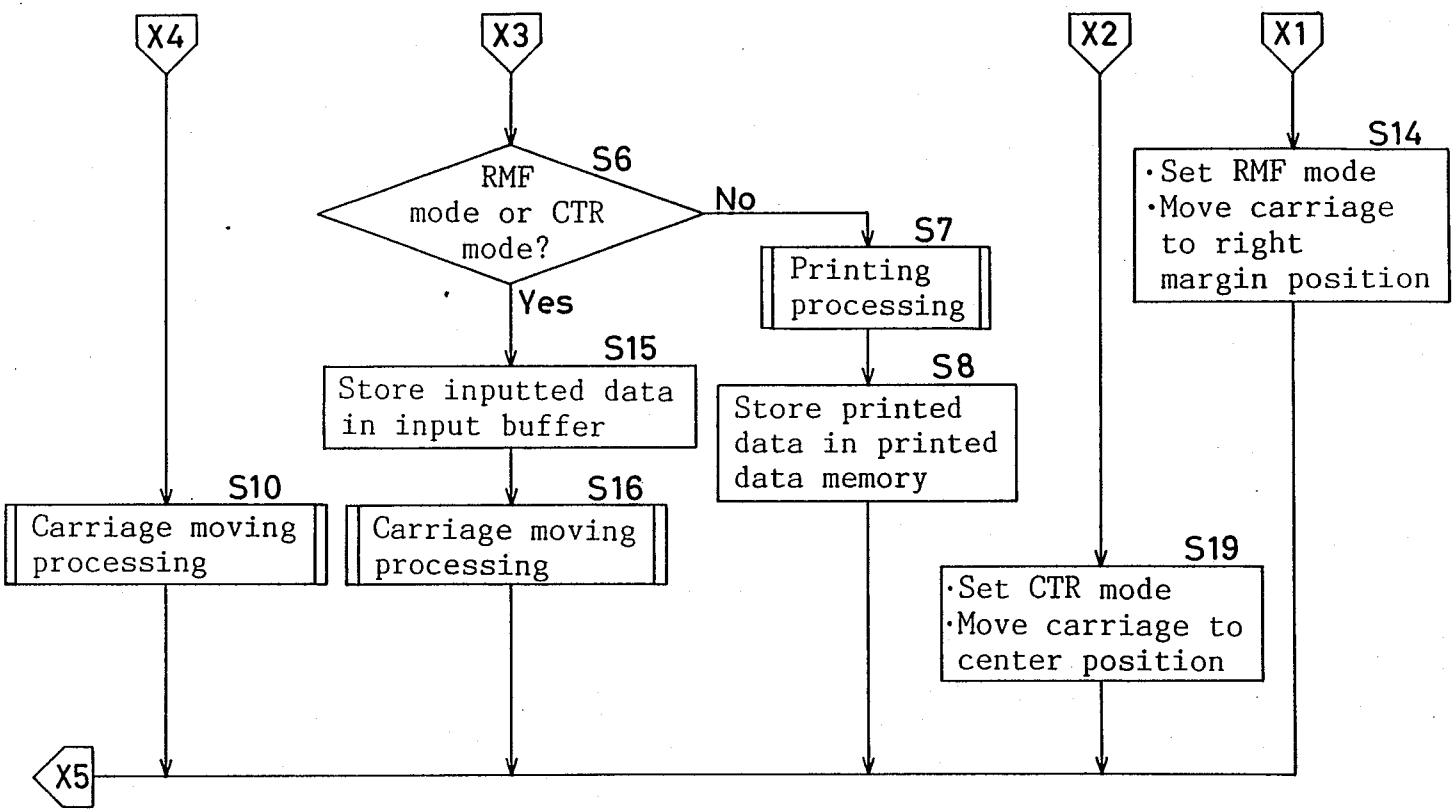
Figure 3:
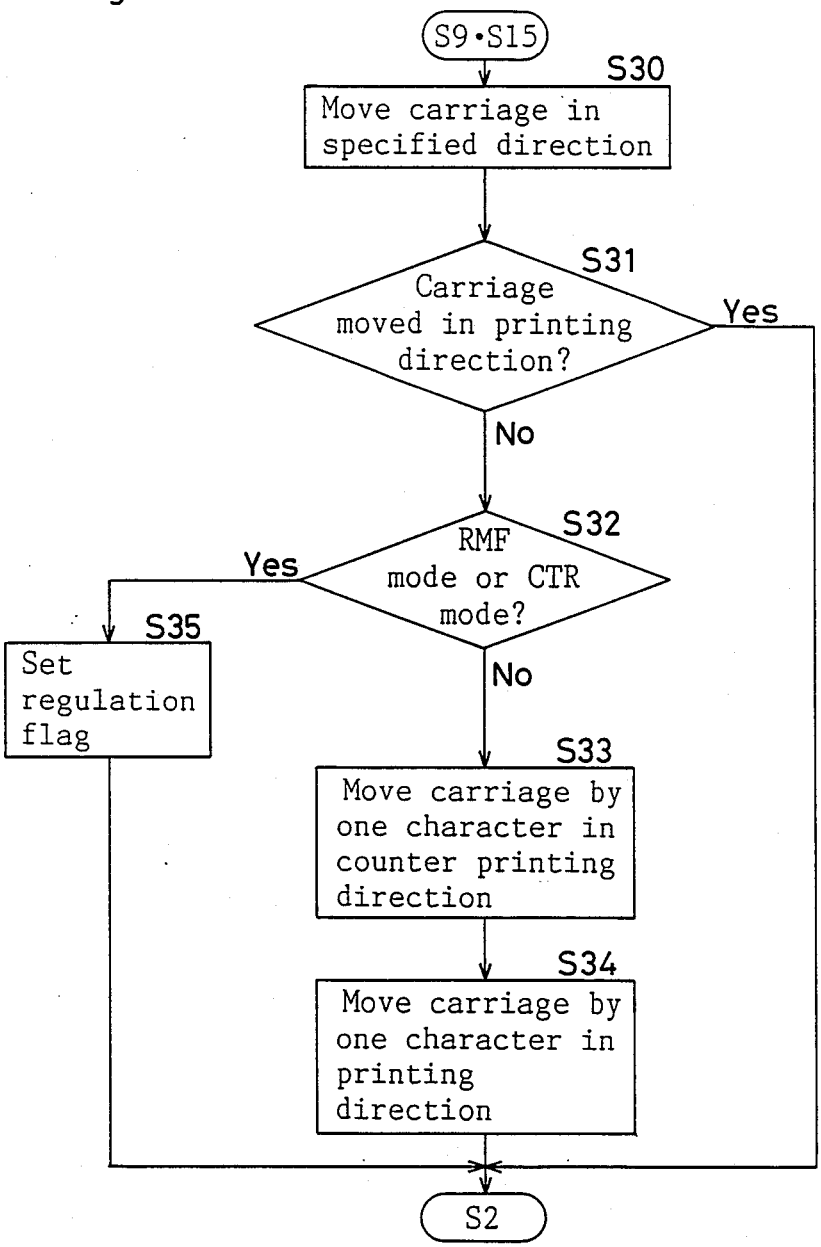
Figure 3:
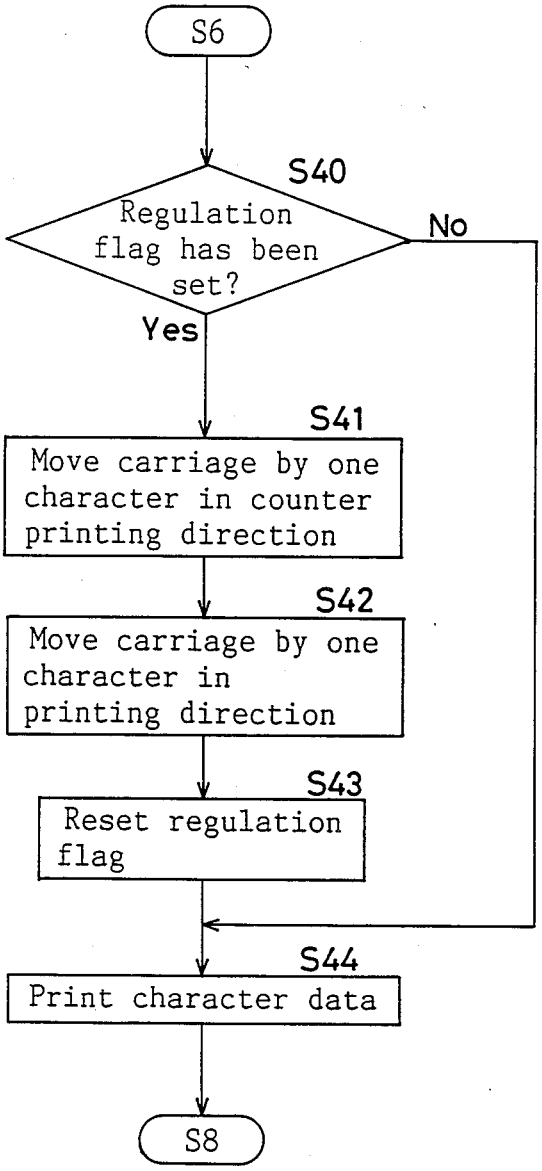
Figure 3E:
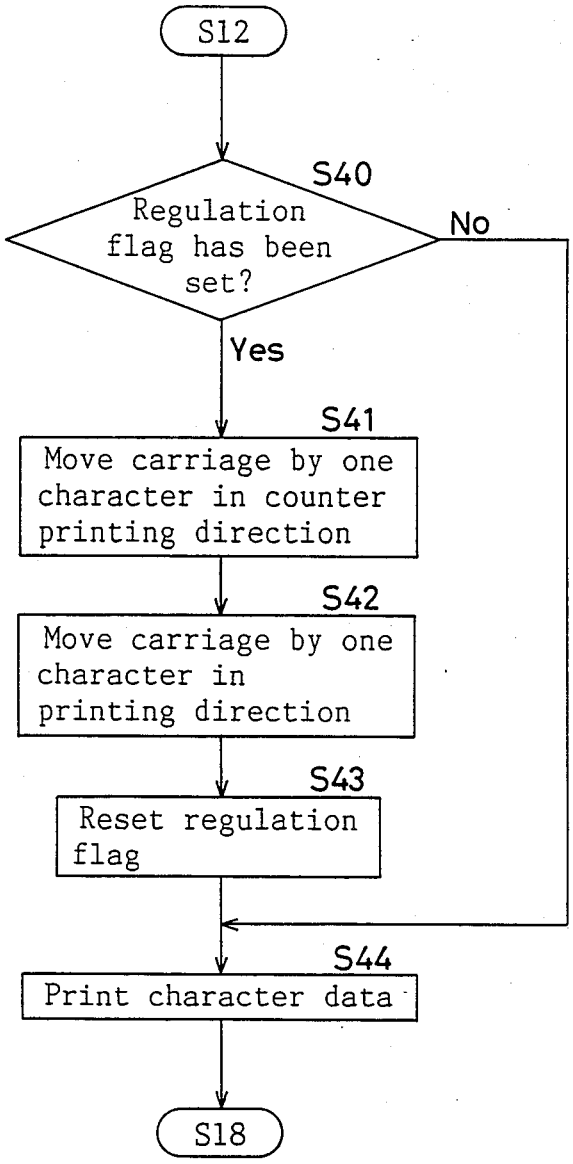

Next, description is made on a routing of controlling regulation of positional deviation of the carriage driving mechanism CM which is performed by the controlling apparatus C of the electronic typewriter 1 in the RMF mode or in the CTR mode based on flow charts in FIGS. 3(*a*)–(*e*).

As shown in FIG. 3(*a*) and FIG. 3(*b*), by turning on the power switch of the typewriter 1, this control is started, and processing proceeds to STEP S1, and initialization such as resetting of the RMF mode flag 56 and the CTR mode flag 57 and setting of the normal printing mode is executed, and processing is ready for a key-input in STEP S2. When a character key 10 is operated in STEP S2, processing proceeds to STEP S6 through STEP S3–STEP S5. In STEP S6, according to data of the RMF mode flag 56 or the CTR mode flag 57, judgment is made on whether or not these flags 56, 57 have been set, that is, whether or not the RMF mode or the CTR mode is in the set state, and if the judgment is NO, processing proceeds to STEP S7.

Description is made on printing processing in STEP S7 with reference to FIG. 3(*d*). First in STEP S40, based on data of the regulation flag 58, judgment is made on whether or not the regulation flag 58 has been set, and if it has not been set, processing proceeds to STEP S44, and the print data is printed in STEP S44. At this time, the CPU 30 outputs a control signal to the drive circuits 90*a*, 81*a*, 82*a*, 28*a*, 83*a* of the printing mechanism PM. Then, processing proceeds to the following STEP S8, and the print data is stored in the printed data memory 51, and processing returns to STEP S2. Thus, by operating character keys 10 consecutively, STEP S2–STEP S8 are repeated and the inputted character string is printed in sequence.

On the other hand, when a carriage move key such as the space key 11 or the backspace key 12 is operated, judgment is made to be YES in STEP S9, and processing proceeds to STEP S10.

Description is made on carriage moving processing in STEP S10 with reference to FIG. 3(*c*). First in STEP S30, when the space key 11 is operated, the carriage 22 is moved by one character in the printing direction, and when the backspace key 12 is operated, the carriage 22 is moved by one character in the counter printing direction. In STEP S31, based on data of the moving direction flag 53, processing returns to STEP S2 when the flag data is "1", that is, when the carriage 22 is moved in the printing direction, and proceeds to STEP S32 when the flag data is "0", that is, when the carriage 22 is moved in the counter printing direction. In STEP S32, judgment is made on whether or not the RMF mode or the CTR mode has been set, and if the judgment results in NO, processing proceeds to STEP S33. STEP S33 and STEP S34 are steps for regulating the positional deviation of the carriage driving mechanism CM, and in STEP S33, the carriage 22 having the print head 27*a* is moved by one character in the counter printing direction, and in STEP S34, the carriage 22 is moved by one character in the printing direction, and processing returns to STEP S2.

Subsequently, when the return key 13 is operated, judgment is made to be YES in STEP S11, and processing proceeds to STEP S12. In STEP S12, judgment is made on whether or not the RMF mode or the CTR mode is in the set state, and if the judgment is NO, processing proceeds to STEP S13. In STEP S13, line feeding processing is executed such that print paper 18 is fed by an amount of the set line space, and the carriage 22 is moved to the left margin position based on data of the left margin position memory 54, and processing returns to STEP S2.

When the RMF key 14 is operated to print inputted data in a right end justified fashion, the judgment results in YES in STEP S3, and processing proceeds to STEP S14. In STEP S14, the RMF mode is set, the RMF mode flag 56 is set (flag data "1"), and the carriage 22 is moved to the right margin position based on data of the right margin position memory 55, and processing returns to STEP S2

Then, when a character key 10 is operated in this state, the judgments in STEP S5 and STEP S6 result in YES, and processing proceeds to STEP S15. In STEP S15, the inputted data is stored in the input buffer 52. Carriage moving processing in the following STEP S16 is identical to the one as described above in FIG. 3(*c*), and the judgment results in YES in STEP S32, and processing proceeds to STEP S35, and the regulation flag 58 for directing regulation of the positional deviation of the carriage driving mechanism CM is set (flag data "1") immediately before starting printing, and processing returns to STEP S2. This means that the inputted character data are sequentially stored in the input buffer 52 by repeating STEP S2–STEP S6, STEP S15 and STEP S16, and the carriage 22 is moved by the number of the inputted characters from the right margin position in the counter printing direction. When the carriage move key is operated, the judgment results in YES in STEP S9, and the carriage moving processing is performed in STEP S10, thereafter processing returning to STEP S2.

Subsequently, when the return key 13 is operated as print start command, the judgments in STEP S11 and STEP S12 result in YES, and processing proceeds to STEP S17. Description is made on printing processing in STEP S17 with reference to FIG. 3(*e*). In STEP S40, based on data of the regulation flag 58, judgment is made on whether or not the regulation flag 58 has been set, and if it has been set, processing proceeds to STEP S41. STEP S41 and STEP S42 are steps for regulating the positional deviation of the carriage driving mechanism CM, and in STEP S41, the carriage 22 is moved by one character in the counter printing direction, and in STEP S42, the carriage 22 is moved by one character in the printing direction. Subsequently in STEP S43, the regulation flag 58 is reset. In STEP S44, the print data stored in the input buffer 52 is printed in the entirety. Then, in the following STEP S18, the printed character data is stored in sequence in the printed data memory 51, and line feeding processing is performed in STEP S13, thereafter processing returning to STEP S2.

This means that in the RMF mode, the return key 13 is operated and backlash compensation is made only once immediately before the print data of the input buffer 52 is printed in the entirety, and therefore in this mode printing can be made on the normal print position having no print position errors due to backlash, and further regulation of backlash of the carriage 22 is not made every time a character is inputted, and therefore useless operation and vibration of the carriage 22 can be suppressed.

When the CTR key 15 is operated to print the inputted data in a center justified fashion, judgment is made to be YES in STEP S4, and processing proceeds to STEP S19. In STEP S19, the CTR mode is set and the CTR mode flag 57 is set (flag data "1"), and based on data of the left margin position memory 54 and the right margin position memory 55, the carriage 22 is moved to the center position between the left margin position and the right margin position, and processing returns to STEP S2.

Then, when a character key 10 is inputted in this state, STEP S2–STEP S6, STEP S15 and STEP S16 are repeated, and the inputted character data is stored in sequence in the input buffer 52, and the carriage 22 is moved by a half of the number of the inputted characters from the center position in the counter printing direction. When the carriage move key is operated, judgment is made to be YES in STEP S9, and processing returns to STEP S2 through STEP S10.

Subsequently, when the return key 13 is operated as print start command, the judgments in STEP S11 and STEP S12 result in YES, and processing proceeds to STEP S17. Printing processing in STEP S17 is identical to the printing processing as described in FIG. 3(*e*), and therefore description thereon is omitted. Then, in the following STEP S18, the printed character data are stored sequentially in the printed data memory 51, and line feeding processing is performed in STEP S13, and thereafter processing returns to STEP S2.

This means that in the CTR mode, the return key 13 is operated and thereby backlash compensation is made only once immediately before the print data of the input buffer 52 is printed in the entirety, and therefore in this mode printing can be made on the normal print position having no print position errors due to backlash, and further backlash of the carriage 22 is not regulated every time a character is inputted, and therefore useless operation and vibration of the carriage 22 can be suppressed.

In addition, when the judgment results in NO in STEP S11, processing proceeds to STEP S20, and processing corresponding to the operated function key 16, 17 is executed, and processing returns to STEP S2.

As described above, in the typewriter mode, inputted data in the CTR mode and the RMF mode are stored in the input buffer 52, and the print start command key such as the return key 13 is operated, and thereby backlash of the carriage 22 is regulated (i.e. corrected) only once immediately before the print data of the input buffer 52 are printed in the entirety. Therefore, in these modes, printing can be made on the normal print position including no print position errors due to backlash between gears 91, 92 and elongation the wire 94.

Furthermore, since backlash of the carriage 22 is not regulated every time a character is inputted, useless motion, vibration and noise of the carriage 22 can be suppressed. In addition, control for regulating backlash can be simplified.

In addition, in the above-mentioned embodiment, description is made on the RMF mode and the CTR mode, but needless to say, the present invention is applicable likewise also to the case where the decimal point position is justified to the decimal tab position in the decimal tab mode and to the case of character erasure in the line-by-line mode (mode of printing on a one-print-line basis).

In the above-mentioned embodiment, description is made on the electronic typewriter provided with the typewheel type printer, but it is needless to say that the present invention is applicable likewise also to a thermal printer, a shuttle type printer or a wire-dot type printer.

What is claimed is:

1. A printing apparatus capable of backlash regulation having inputting means for inputting code data of characters and various command signals comprising:

printing means for printing characters on a print paper with a print head mounted on a carriage movable forward and backward along a print line by a carriage drive system;

store means for storing inputted data from said inputting means;

control means for controlling said printing means;

mode setting means for setting said control means at a specified mode in which, according to a command signal from said inputting means, each inputted data is stored in said store means successively while backspacing said carriage from a given reference position determined by the mode setting means to a predetermined print position determined by said inputted data stored in said store means without regulating a positional deviation in the carriage driving system, and then said inputted data in said store means are printed together in response to a print start command signal; and regulating means for controlling said printing means to regulate said positional deviation in said carriage driving system in response to said print start command signal in said specified mode.

2. A printing apparatus according to claim 1; wherein said regulating means controls said printing means to regulate said positional deviation by means of moving said carriage backward by an amount predetermined according to a print pitch and then moving said carriage forward by said amount predetermined according to a print pitch.

3. A printing apparatus according to claim 1; wherein said mode setting means comprises means for setting said control means at a centering mode.

4. A printing apparatus according to claim 1; wherein said mode setting means comprises means for setting said control means at a right margin flush mode.

* * * * *